United States Patent [19]

Futter et al.

[11] Patent Number: 4,944,625

[45] Date of Patent: Jul. 31, 1990

[54] POWDER-APPLYING BRUSH

[75] Inventors: Menachem Futter, Staten Island, N.Y.; James E. Wilson, Bound Brook, N.J.; Annette M. Golden, New York, N.Y.

[73] Assignee: Revlon, Inc., New York, N.Y.

[21] Appl. No.: 260,768

[22] Filed: Oct. 21, 1988

[51] Int. Cl.[5] ..... A45D 33/06; A46B 11/04

[52] U.S. Cl. ..... 401/153; 401/184; 401/270; 222/189

[58] Field of Search ..... 401/153, 268, 270, 279, 401/283, 288, 280; 222/211, 189, 3, 623

[56] References Cited

U.S. PATENT DOCUMENTS

| | | | |
|---|---|---|---|
| 133,444 | 11/1872 | Hauck | 222/211 |
| 1,121,788 | 12/1914 | Bongiovanni | 401/281 |
| 1,175,705 | 3/1916 | Ciai | 401/281 |
| 1,231,834 | 7/1917 | Amadeo | 401/277 |
| 1,401,508 | 12/1921 | D'Alessandro | 401/281 |
| 1,481,499 | 8/1922 | Bongiovanni | 401/281 |
| 1,506,292 | 2/1924 | Corsello | 401/281 |
| 1,690,022 | 4/1928 | Langhaus . | |
| 1,757,650 | 2/1929 | Arico . | |
| 2,551,676 | 2/1948 | Hoffman | 222/215 |
| 2,825,080 | 3/1958 | Bongiovanni | 401/281 |
| 2,867,828 | 1/1959 | Trutneff | 401/281 |
| 2,903,728 | 9/1959 | Pecorara | 401/270 |
| 3,154,222 | 10/1964 | Heckman | 401/186 |
| 3,167,806 | 2/1965 | Hogan . | |
| 3,256,550 | 6/1966 | Laxalt | 401/281 |
| 4,044,836 | 8/1977 | Martin et al. | 222/215 |
| 4,066,367 | 1/1978 | Sherosky | 401/286 |
| 4,143,982 | 3/1979 | Cox et al. | 401/280 |
| 4,248,543 | 2/1981 | Carrington et al. | 401/269 |
| 4,319,852 | 3/1982 | Bell et al. | 401/185 |
| 4,371,101 | 2/1983 | Cane | 222/189 |
| 4,626,119 | 12/1986 | Ladd, Jr. | 401/123 |
| 4,630,954 | 12/1986 | Ladd, Jr. | 401/123 |
| 4,630,955 | 12/1986 | Ladd, Jr. et al. | 401/123 |
| 4,640,440 | 2/1987 | Ford, Jr. et al. | 222/190 |
| 4,647,240 | 3/1987 | Ladd, Jr. et al. | 401/123 |
| 4,652,162 | 3/1987 | Ladd, Jr. et al. | 401/123 |
| 4,671,690 | 6/1987 | Ladd, Jr. et al. | 401/123 |
| 4,723,691 | 2/1988 | Minkevitch | 222/210 |
| 4,730,751 | 3/1988 | Mackles | 222/189 |

FOREIGN PATENT DOCUMENTS

| | | | |
|---|---|---|---|
| 546981 | 10/1985 | Australia . | |
| 441911 | 7/1941 | Belgium . | |
| 599500 | 6/1934 | Fed. Rep. of Germany . | |
| 600385 | 10/1981 | United Kingdom | 401/283 |

*Primary Examiner*—Richard J. Johnson

*Attorney, Agent, or Firm*—Ralph W. Selitto, Jr.

[57] ABSTRACT

A powder-dispensing brush of the pressure-feed type employs a self-cleaning filter which performs an anti-clogging function, as well as a filtering function. The brush also employs a valve which can be switched between an on position and an off position in order to control the dispensing of powder from the brush.

44 Claims, 4 Drawing Sheets

POWDER-APPLYING BRUSH

Field of the Invention

The present invention relates to brushes and, more particularly, to brushes which are adapted to dispense powder or the like.

Background of the Invention

Powder-dispensing brushes have been known for many years. In general, there are two basic types of powder-dispensing brushes: a gravity-feed type and a pressure-feed type. Each of these types will be described in greater detail below.

The gravity-feed type delivers powder from a source within the body of the brush to the brush's bristles (see, for example, U.S. Pat. Nos. 1,121,788; 1,175,705; 2,903,728; 3,167,806; 4,143,982 and 4,626,119). This type of powder brush is disadvantageous because the brush can only be used in a powder-dispensing mode when the source of powder is located above the brush's bristles. Another disadvantage is that these brushes can clog rather easily.

The pressure-feed type employs a resilient body or appendage adapted to be squeezed so as to forcibly expel powder from the body of the brush into the brush's bristles (see, for instance, U.S. Pat. Nos. 1,757,650; 2,825,080; 4,248,543 and 4,319,852). This type of powder brush suffers from an inability to dispense uniform amounts of powder on a regular basis. Like the gravity-feed type, the pressure-feed type also suffers from a clogging problem.

Summary of the Invention

The present invention relates to a new and improved powder-dispensing brush of the pressure-feed type. The new and improved brush includes a housing which contains a predetermined quantity of powder to be dispensed from a dispensing mechanism, such as a nozzle, arranged at one end of the housing. A propelling mechanism, which can be in the form of bellows, is located at an opposite end of the housing for propelling powder from the housing through the dispensing mechanism and into the brush's bristles. In accordance with one aspect of the present invention, the powder passes through a filter before it is dispensed from the dispensing mechanism. In addition to performing a filtering function, the filter also performs an anti-clogging function.

The use of a bellows-type propelling mechanism is advantageous because the bellows can be adapted for manual compression by a user's thumb. After such compression, the bellows automatically expand to thereby cause outside air to be sucked into the housing through the dispensing mechanism and the filter. This reverse air flow through the filter causes powder to be expelled therefrom and returned to the housing in a loosened and aerated condition, whereby the powder is pre-conditioned for the next dispensing operation and the filter is automatically cleaned.

In accordance with another aspect of the present invention, the new and improved brush is provided with a control mechanism for controlling the flow of powder through the dispensing mechanism. The control mechanism operates to open and close an outlet which extends through the dispensing mechanism.

When the outlet is closed, accidental or inadvertent dispensing of powder is prevented.

Brief Description of the Drawings

For a better understanding of the present invention, reference is made to the following detailed description of three exemplary embodiments considered in conjunction with the accompanying drawings, in which.

Description of the Exemplary Embodiments

Although the present invention can be used to dispense many different types of powder and similar materials, it is especially suitable for use in the dispensing of cosmetic powders. Accordingly, the invention will be described in connection with a new and unique brush adapted to dispense and apply a powdery cosmetic product.

Figure 1:
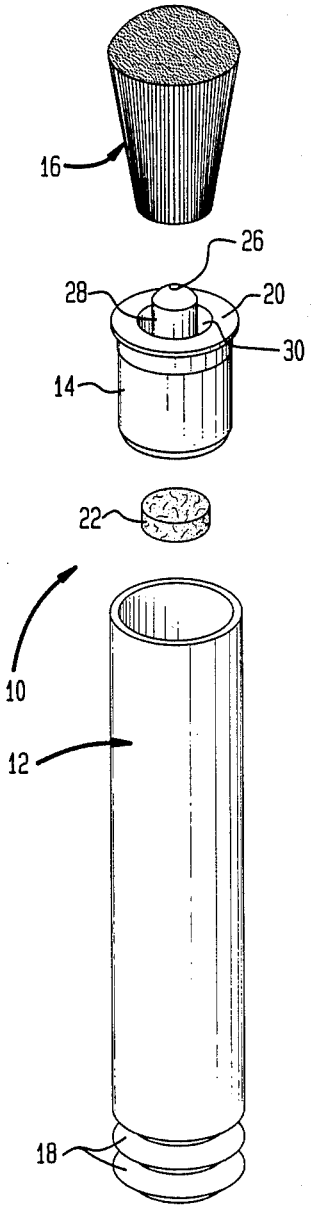
FIG. 1 is an exploded perspective view of a powder-dispensing brush constructed in accordance with one exemplary embodiment of the present invention.
Figure 2:
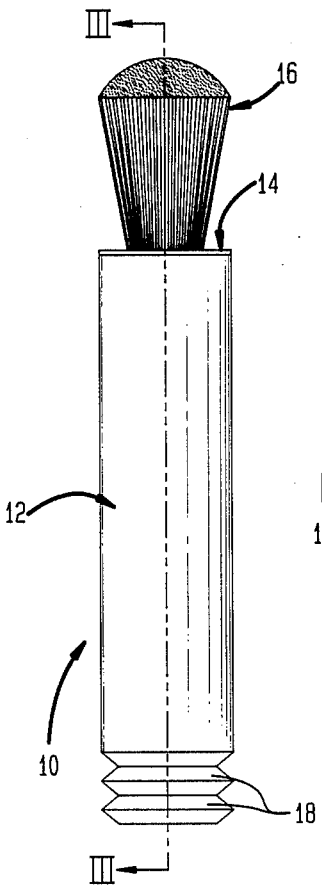
FIG. 2 is an elevational view of the powder-dispensing brush illustrated in FIG. 1.
Figure 3:
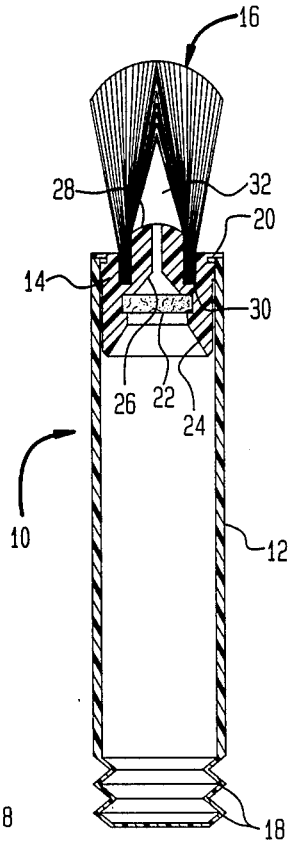
FIG. 3 is a cross-sectional view, taken along section line III—III in FIG. 2 and looking in the direction of the arrows, of the powder-dispensing brush illustrated in FIG. 2.
Figure 4:
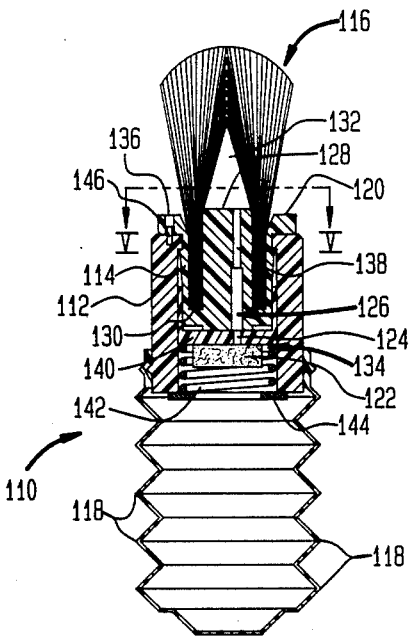
FIG. 4 is a cross-sectional view, similar to FIG. 2, of a powder-dispensing brush constructed in accordance with another exemplary embodiment of the present invention, the brush being shown with its dispensing nozzle in an open or on position.

With reference to FIGS. 1–3, a powder-dispensing brush 10 includes three main components: a housing 12; a bristle holder 14; and bristles 16. Set forth below is a detailed description of each of these components, followed by an operational description of the brush 10.

The housing 12, which is preferably injection blow molded out of a suitable plastic material, has a closed end defined by bellows 18, which are molded monolithically with the housing 12. The opposite end of the housing 12 is open so that the housing 12 can be supplied with a predetermined quantity of a cosmetic powder (not shown). Except for the bellows 18, the housing 12 is otherwise substantially rigid. As can be seen in FIG. 3, the wall thickness of the bellows 18 is less than the wall thickness of the rest of the housing 12 and is selected so as to permit the bellows 18 to be depressed (i.e., compressed) by a user in connection with the performance of a dispensing operation, which will be described hereinafter. The material from which the housing 12 is made must be chosen so as to provide the bellows 18 with an elastic memory, whereby the bellows 18 will automatically return to their as molded (i.e., uncompressed) state upon the conclusion of a dispensing operation.

The bristle holder 14, which is preferably injection molded out of a suitable plastic material, has a shoulder 20 which engages the open end of the housing 12 when the bristle holder 14 is press fitted into the housing 12. A foam pad 22, which can be made from any suitable type of filter material (e.g., urethane) having an open cell construction, is mounted in the bristle holder 14 between an inlet 24 (see FIG. 3) and an outlet 26 (see FIGS. 1 and 3), which extends through a nozzle section 28 of the bristle holder 14. The inlet 24 and the outlet 26 are tapered so as to promote the flow of powder through the bristle holder 14 during a dispensing operation. The tapered outlet 26 also functions to increase the discharge velocity of the powder exiting the nozzle section 28 of the bristle holder 14. An annular trough 30 surrounds the nozzle section 28 for a purpose to be described hereinafter.

The bristles 16 are attached to the brush holder 14 by inserting them into the trough 30 and then securing them in place by glue or any other suitable adhesive. A void 32 (see FIG. 3) is formed within the bristles 16, the void 32 functioning as a collection area for the powder discharged from the outlet 26 of the nozzle section 28.

In operation, a user wraps his or her hand around the housing 12 of the brush 10 and then depresses the bellows 18 with the thumb of the same hand. As the bellows 18 collapse, the volume of the housing 12 decreases, thereby forcing a metered amount of powder from the housing 12 and into the inlet 24 of the bristle holder 14. After being filtered by the foam pad 22, the powder enters the outlet 26 of the nozzle section 28 and, from there, is discharged into the void 32 created within the bristles 16. The powder can then be applied to the user's body by a brushing action. Because its relatively simple design results in comparatively low manufacturing costs, the brush 10 can be thrown away after all of the powder has been dispensed therefrom.

In addition to the filtering function described above, the foam pad 22 also serves an anti-clogging function by inhibiting the individual powder particles from agglomerating prior to their delivery to the outlet 26 of the nozzle section 28. The foam pad 22 is self cleaning in that the expansion of the bellows 18 at the conclusion of the dispensing operation generates a reverse air flow which expels powder particles from the foam pad 22, the expelled particles being returned to the powder supply contained in the housing 12. Because the reverse air flow loosens and aerates the powder particles being returned to the housing 12, the powder supply contained in the housing 12 is preconditioned (i.e., pre-loosened) in preparation for the next dispensing operation.

Two other exemplary embodiments of a powder-dispensing brush constructed in accordance with the present invention are illustrated in FIGS. 4–7 and in FIGS. 8–12, respectively. Elements illustrated in FIGS. 4–7 which correspond to the elements described above with respect to the embodiment illustrated in FIGS. 1–3 have been designated by corresponding reference numerals increased by one hundred. Elements illustrated in FIGS. 8–12 which correspond to the elements described above with respect to the embodiment illustrated in FIGS. 1–3 have been designated by corresponding reference numerals increased by two hundred. The embodiment of FIGS. 4–7 and the embodiment of FIGS. 8–12 operate in the same manner as the embodiment of FIGS. 1–3 unless otherwise stated.

Referring to FIGS. 4–7, a powder-dispensing brush 110 includes the following main components: a housing 112; a bristle holder 114; bristles 116; a foam pad 122; and a valve and seal assembly 134. Except for the valve and seal assembly 134, all of these components are extremely similar to their counterparts in the embodiment of FIGS. 1–3. Accordingly, the following discussion will focus on the details of the valve and seal assembly 134, while merely summarizing how the other components differ from their counterparts which have been described in detail in connection with the foregoing description of the embodiment of FIGS. 1–3.

One end of the housing 112 is press fitted into an open end of bellows 118. The opposite end of the housing 112 rotatably receives the bristle holder 114.

The bristle holder 114 has a shoulder 120 which slides on the adjacent end of the housing 112 as the bristle holder 114 is rotated relative to the housing 112. An arcuate slot 136 is provided in the shoulder 120 of the bristle holder 114 for a purpose Which will be described hereinafter. An outlet 126 is provided in a nozzle section 128 of the bristle holder 114. The outlet 126, which is arranged eccentrically with respect to the axis of rotation of the bristle holder 114 for a purpose to be described hereinafter, has a reduced diameter portion 138. An annular trough 130 receives the bristles 118, which form a void 132 in the vicinity of the nozzle section 128 of the bristle holder 114.

The valve and seal assembly 134 includes a valve disc 140, which is non-rotatably mounted in the housing 112 but which is movable in an axial direction within the housing 112. The valve disc 140 has an inlet 124 which, like the outlet 126, is arranged eccentrically with respect to the axis of rotation of the bristle holder 114. The interaction of the inlet 124 and the outlet 126 is described below.

The valve and seal assembly 134 also includes a coil spring 142 mounted in the housing 112 between the valve disc 140 and a washer 144, which is ultrasonically welded to the housing 112. The coil spring 142 performs a sealing function by constantly urging the valve disc 140 into intimate contact with the bristle holder 114 to thereby inhibit powder flowing through the inlet 124 from escaping and working its way between the bristle holder 114 and the valve disc 140.

The foam pad 122 is mounted in the housing 112 for movement between the valve disc 140 and the washer 144. The coil spring 142 surrounds the foam pad 122 without inhibiting its mobility.

A pin 146 extends from the housing 112 into the arcuate slot 136 provided in the shoulder 120 of the bristle holder 114. The slot 136 and the pin 146 cooperate in a manner which will be evident from the following description of the operation of the brush 110.

The brush 110 is operated in the same basic manner as the brush 10 in order to perform a dispensing operation. During such a dispensing operation, the inlet 124 and the outlet 126 must be in alignment with each other. To align the inlet 124 and the outlet 126, the bristle holder 114 is rotated relative to the valve disc 140 to the "open" or "on" position illustrated in FIGS. 4 and 5. In this "open" or "on" position, the pin 146 abuts one end of the arcuate slot 136 (see FIG. 5).

Figure 6:
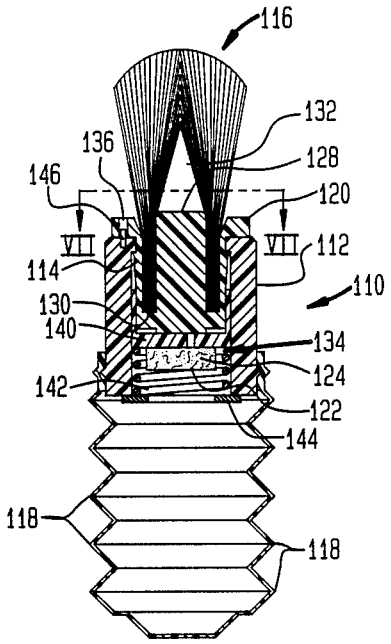
FIG. 6 is a cross-sectional view, similar to FIG. 4, of the powder-dispensing brush illustrated in FIG. 4, the brush being shown with its dispensing nozzle in a closed or off position.
Figure 5:
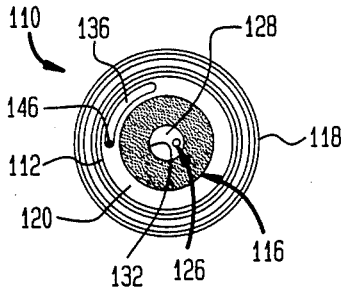
FIG. 5 is a cross-sectional view, taken along section line V—V in FIG. 4 and looking in the direction of the arrows, of the powder-dispensing brush illustrated in FIG. 4.
Figure 7:
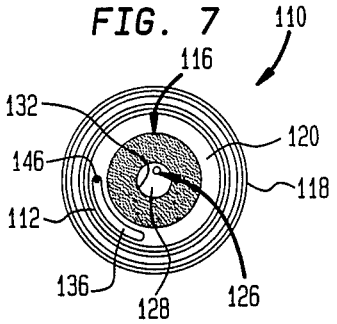
FIG. 7 is a cross-sectional view, taken along section line VII—VII in FIG. 6 and looking in the direction of the arrows, of the powder-dispensing brush illustrated in FIG. 6.
Figure 8:
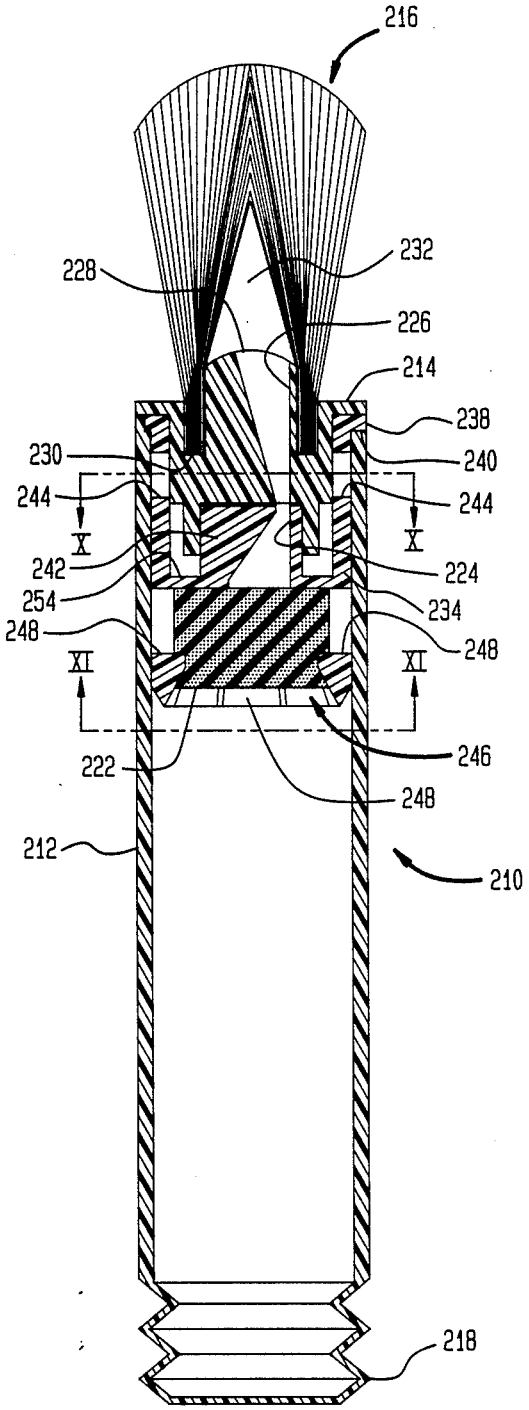
FIG. 8 is a cross-sectional view, similar to FIG. 2, of a powder dispensing brush constructed in accordance with yet another exemplary embodiment of the present invention, the brush being shown with its dispensing nozzle in an open or on position.

At the conclusion of the dispensing operation, the bristle holder 114 can be rotated to the "closed" or "off" position illustrated in FIGS. 6 and 7. In this "closed" or "off" position, which is reached when the pin 146 abuts the opposite end of the arcuate slot 136 (i.e., when the bristle holder 114 has been rotated about 75°), the inlet 124 and the outlet 126 are no longer aligned, thereby preventing powder from entering and flowing through the outlet 126. Thus, the brush 110 is, in effect, provided with an on-off switch which inhibits the accidental or inadvertent dispensing of powder.

With reference now to FIGS. 8–12, a powder-dispensing brush 210 includes the following main components: a housing 212; a bristle holder 214; bristles 216; a foam pad 222; and a bushing 234. Except for the bushing 234, all of these components are extremely similar to their counterparts in the embodiment of FIGS. 1–3. Accordingly, the following discussion will focus on the details of the bushing 234, while merely summarizing how the other components differ from their counterparts which have been described in detail in connection with the foregoing description of the embodiment of FIGS. 1–3.

Figure 9:
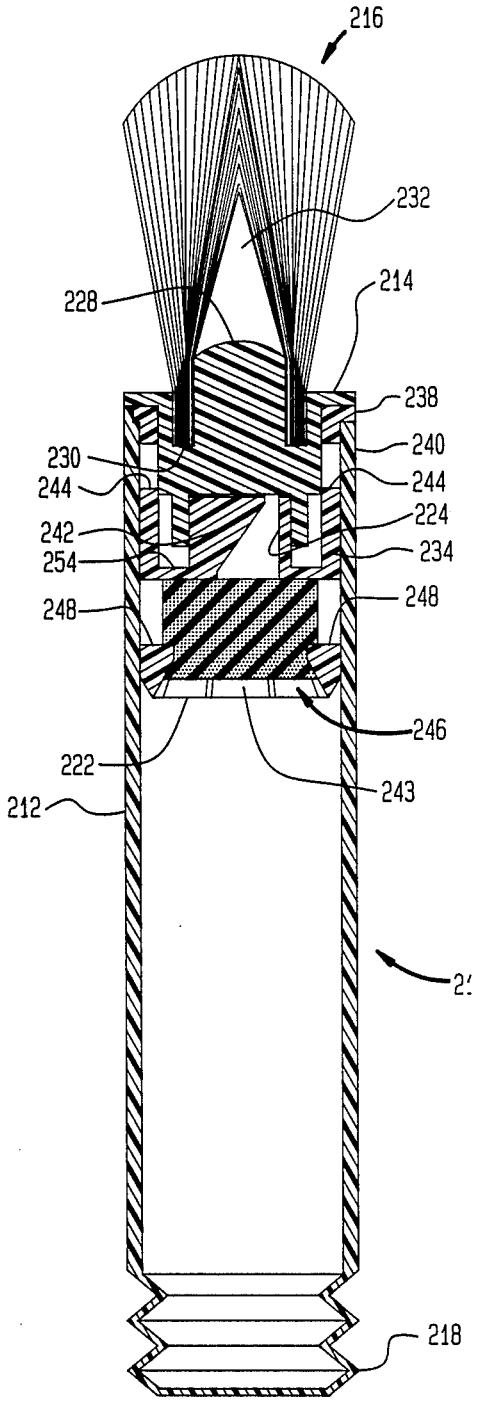
FIG. 9 is a cross-sectional view, similar to FIG. 8, of the powder-dispensing brush illustrated in FIG. 8, the brush being shown with its dispensing nozzle in a closed or off position.
Figure 10:
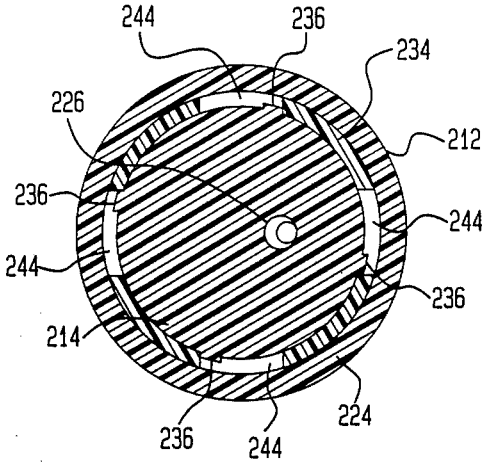
FIG. 10 is a cross-sectional view, taken along section line X—X in FIG. 8 and looking in the direction of the arrows, of the powder-dispensing brush illustrated in FIG. 8.
Figure 11:
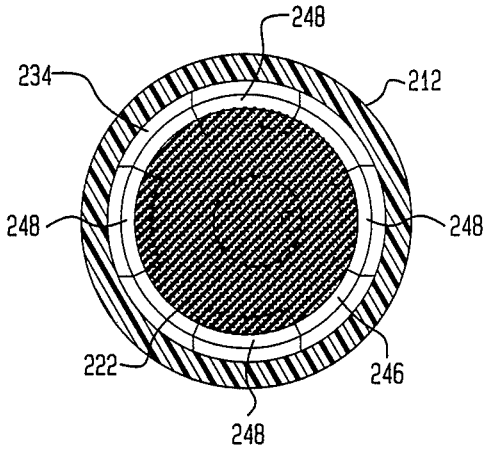
FIG. 11 is a cross-sectional view, taken along section line XI—XI in FIG. 8 and looking in the direction of the arrows, of the powder-dispensing brush illustrated in FIG. 8.

The bristle holder 214 is rotatably mounted in the bushing 234 such that the bristle holder 214 can be rotated between an "open" or "on" position (see FIGS. 8 and 10) and a "closed" or "off" position (see FIGS. 9 and 11). Ears 236 (see FIG. 10) extend radially outwardly from the bristle holder 214 for a purpose which will be described hereinafter. An outlet 226 is provided in a nozzle section 228 of the bristle holder 214. The outlet 226 is arranged eccentrically with respect to the axis of the rotation of the bristle holder 214 for a purpose to be described hereinafter and is flared so as to facilitate molding of the bristle holder 214. An annular trough 230 receives the bristles 216, which form a void 232 in the vicinity of the nozzle section 228 of the bristle holder 214.

The bushing 234 has a tongue 238, which engages a groove 240 in an open end of the housing 212 in order to prevent the bushing 234 from rotating relative to the housing 212. A nozzle section 242 of the bushing 234 includes an inlet 224 which, like the outlet 226, is arranged eccentrically with the respect to the axis of rotation of the bristle holder 214 so that the inlet 224 and the outlet 226 can interact in a manner to be described below. The bushing 234 also has radially extending openings 244, each of which receives a corresponding one of the ears 236 on the bristle holder 214 for purposes which will be evident when the operation of the brush 210 is described hereinafter. The bushing 234 also includes a chamber 246 which houses the foam pad 222. Mounting prongs 248, which extend radially into the chamber 246, fixedly position the foam pad 222 in the chamber 246 in abutting relationship with the inlet 224.

Figure 12:
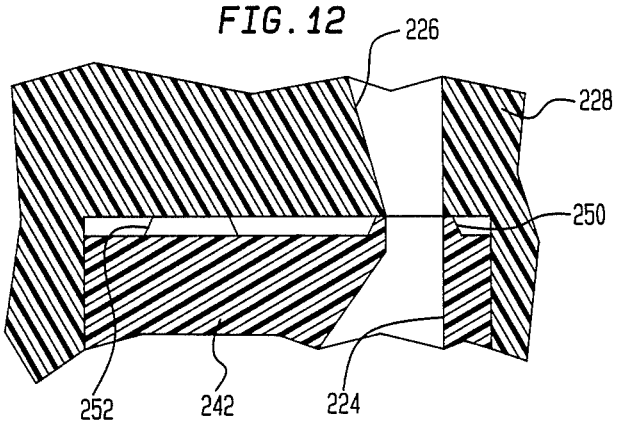
FIG. 12 is a blowup of a portion of the powder-dispensing brush illustrated in FIG. 11, the blown-up portion being shown in an enlarged scale to facilitate consideration and discussion.

In order to provide an air-tight seal at the interface between the inlet 224 and the outlet 226, a projection 250, through which a portion of the inlet 224 passes, extends from the nozzle section 242 of the bushing 234 to the nozzle section 228 of the bristle holder 214 (see FIG. 12). Levelling lugs 252 (only one of which is visible in FIG. 12) cooperate with the projection 250 so as to maintain the proper orientation of the nozzle section 242 in a manner which will be described in greater detail below.

The bushing 234 also includes an annular web 254 which surrounds the nozzle section 242 of the bushing 234. The web 254 has a flexibility selected such that during the insertion of the bristle holder 214 into the bushing 234, the , web 254 is deflected toward bellows 218 located at a closed end of the housing 212. As a result of such deflection of the web 254, the web 254 functions like a spring to constantly urge the nozzle section 242 of the bushing 234 toward the nozzle section 228 of the bristle holder 214, whereby the projection 250 is constantly urged into intimate sealing contact with the nozzle section 228 to thereby promote the formation of an air-tight seal between the inlet 224 and the outlet 226. Because the nozzle section 242 is constantly being urged toward the nozzle section 228 and the projection 250 is arranged eccentrically on the nozzle section 242, the nozzle section 242 would, in the absence of the levelling lugs 252, tend to be forced out of its desired coaxial alignment with the nozzle section 228, thereby jeopardizing the formation of an air-tight seal between the inlet 224 and the outlet 226. Accordingly, the levelling lugs 252 are employed in order to maintain the desired coaxial relationship between the nozzle section 242 and the nozzle section 228 and to further promote the formation of an air-tight seal between the inlet 224 and the outlet 226.

The brush 210 is operated in the same basic manner as the brush 10 in order to perform a dispensing operation. During such a dispensing operation, the inlet 224 and the outlet 226 must be in alignment with each other. To align the inlet 224 and the outlet 226, the bristle holder 214 is rotated relative to the bushing 234 to the "open" or "on" position illustrated in FIGS. 8 and 10–12. In this "open" or "on" position, each of the ears 236 abuts one end of a corresponding one of the openings 244 (see FIG. 10).

At the conclusion of the dispensing operation, the bristle holder 214 can be rotated to the "closed" or "off" position illustrated in FIG. 9. In this "closed" or "off" position which is reached when each of the ears 236 abuts the opposite end of a corresponding one of the openings 244 (i.e., when the bristle holder 214 has been rotated about 40°), the inlet 224 and the outlet 226 are no longer aligned, thereby preventing powder from entering and flowing through the outlet 226. Thus, the brush 210 is, in effect, provided with an on-off switch which inhibits the accidental or inadvertent dispensing of powder.

In addition to limiting the rotational movement of the bristle holder 214, the ears 236 also cooperate with the openings 244 to fix the axial position of the bristle holder 214 relative to the bushing 234. By fixing the axial position of the bristle holder 214 relative to the bushing 234, the formation of an air-tight seal between the inlet 224 and the outlet 226 is facilitated.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

We claim:

1. A powder-dispensing brush, comprising a substantially rigid housing having a capacity selected such that a predetermined quantity of powder can be stored in said housing; bristles projecting outwardly from one end of said housing; dispensing means positioned in said one end of said housing for dispensing powder from said housing into said bristles; filtering means for filtering powder before it is dispensed from said dispensing means, whereby said filtering means inhibits said dispensing means from becoming clogged; and propelling means located at an opposite end of said housing for propelling powder from said housing through said dispensing means and into said bristles, said propelling means including compressible bellows which communicate with said housing, said bellows being manually compressible by a thumb of a user to thereby reduce the capacity of said housing and being automatically expandable after their compression to thereby cause outside air to be sucked into said housing through said dispensing means and said filtering means, whereby powder is expelled from said filtering means and returned to said housing in a loosened and aerated condition.

2. A powder-dispensing brush according to claim 1, wherein said filtering means includes a foam pad having an open cell construction.

3. A powder-dispensing brush according to claim 2, wherein said dispensing means includes a nozzle and said filtering means is positioned in said nozzle.

4. A powder-dispensing brush according to claim 1, wherein said bellows are molded monolithically with said housing, said bellows having a wall thickness which is less than that of said housing.

5. A powder-dispensing brush according to claim 1, wherein said bellows are formed separately from said housing.

6. A powder-dispensing brush according to claim 5, wherein said housing is press fitted into said bellows.

7. A powder-dispensing brush according to claim 1, wherein said bristles include a void in the vicinity of said dispensing means, whereby powder dispensed from said dispensing means is collected in said void.

8. A powder-dispensing brush according to claim 1, further comprising controlling means for controlling the flow of powder through said dispensing means.

9. A powder-dispensing brush according to claim 8, wherein said dispensing means includes an outlet and said controlling means has an open position in which said outlet communicates with said housing and a closed position in which said outlet does not communicate with said housing.

10. A powder-dispensing brush according to claim 9, wherein said dispensing means includes a nozzle which is rotatable about an axis of rotation, said outlet extending through said nozzle and being arranged eccentrically with respect to said axis of rotation, and said controlling means is non-rotatably mounted in said housing in face-to-face contact with said dispensing means, said controlling means including an inlet extending therethrough and being arranged eccentrically with respect to said axis of rotation such that said inlet is in alignment with said outlet when said controlling means is in its said open position and such that said inlet is out of alignment with said outlet when said controlling means is in its said closed position.

11. A powder-dispensing brush according to claim 10, further comprising sealing means for forming a seal between said nozzle and said controlling means to thereby inhibit the escape of powder as it passes from said inlet to said outlet.

12. A powder-dispensing brush according to claim 11, wherein said controlling means includes a valve disc which is movable in an axial direction relative to said housing and said sealing means includes urging means for urging said valve disc into intimate contact with said nozzle.

13. A powder-dispensing brush according to claim 12, wherein said housing includes an inwardly extending projection and said urging means includes a spring positioned between said valve disc and said projection.

14. A powder-dispensing brush according to claim 13, wherein said filtering means is a foam pad having an open cell construction, said foam pad being movably received in said housing between said valve disc and said projection and being surrounded by said spring.

15. A powder-dispensing brush according to claim 12, wherein said nozzle is rotatable between a first position in which said outlet is in alignment with said inlet and a second position in which said outlet is out of alignment with said inlet.

16. A powder-dispensing brush according to claim 15, wherein said controlling means includes limiting means for limiting the rotation of said nozzle such that said nozzle cannot be rotated beyond its said first and second positions.

17. A powder-dispensing brush according to claim 16, wherein said limiting means includes a pin extending outwardly from said housing and an arcuate slot provided in said nozzle so as to receive said pin in such a manner that said pin engages one end of said slot when said nozzle is in its said first position and said pin engages an opposite end of said slot when said nozzle is in its second position.

18. A powder-dispensing brush according to claim 11, wherein said controlling means includes a bushing which is fixedly positioned in said one end of said housing, said bushing including another nozzle through which said inlet passes and urging means for urging said another nozzle into intimate contact with said nozzle of said dispensing means.

19. A powder-dispensing brush according to claim 18, wherein said urging means includes an annular web having a flexibility selected such that said web is deflectable toward said opposite end of said housing in response to the insertion of said dispensing means into said bushing.

20. A powder-dispensing brush according to claim 19, wherein said web is molded monolithically with said bushing.

21. A powder-dispensing brush according to claim 19, wherein said another nozzle includes a projection through which a portion of said inlet passes, said projection extending from said another nozzle to said nozzle of said dispensing means.

22. A powder-dispensing brush according to claim 21, wherein said another nozzle includes levelling lugs extending from said another nozzle to said nozzle of said dispensing means.

23. A powder-dispensing brush according to claim 18, wherein said bushing includes holding means for holding said filtering means against said inlet such that said inlet is located between said filtering means and said outlet.

24. A powder-dispensing brush according to claim 23, wherein said filtering means is a foam pad having an open cell construction, said foam pad being held in a substantially stationary position by said holding means.

25. A powder-dispensing brush according to claim 18, wherein said nozzle of said dispensing means is rotatable between a first position in which said outlet is in alignment with said inlet and a second position in which said outlet is out of alignment with said inlet.

26. A powder-dispensing brush according to claim 25, wherein said controlling means includes limiting means for limiting the rotation of said nozzle of said dispensing means such that said nozzle cannot be rotated beyond its said first and second positions.

27. A powder-dispensing brush according to claim 26, wherein said limiting means includes a plurality of the ears projecting radially outwardly from said dispensing means and a plurality of openings provided in said bushing, each of said openings receiving a corresponding one of said ears such that each of said ears engages one end of a corresponding one of said openings when said nozzle of said dispensing means is in its said first position and such that each of said ears engages an opposite end of a corresponding one of said openings when said nozzle of said dispensing means is in its said second position.

28. A powder-dispensing brush, comprising a housing having a capacity selected such that a predetermined quantity of powder can be stored in said housing; bristles projecting outwardly from one end of said housing; dispensing means positioned in said one end of said housing for dispensing powder from said housing into said bristles, said dispensing means including a nozzle which is rotatable about an axis of rotation and an outlet which extends through said nozzle and which is arranged eccentrically with respect to said axis of rotation; propelling means located at an opposite end of said housing for propelling powder from said housing through said dispensing means and into said bristles; controlling means, non-rotatably mounted in said housing in face-to-face contact with said dispensing means, for controlling the flow of powder through said dispensing means, said controlling means having an open position in which said outlet of said dispensing means communicates with said housing and a closed position in which said outlet of said dispensing means does not communicate with said housing, and said controlling means including an inlet extending therethrough and being arranged eccentrically with respect to said axis of rotation such that said inlet is in alignment with said outlet of said dispensing means when said controlling means is in its said open position and such that said inlet is out of alignment with said outlet of said dispensing means when said controlling means is in its said closed position; sealing means for forming a seal between said nozzle and said controlling means to thereby inhibit the excape of powder as it passes from said inlet of said controlling means to said outlet of said despensing means; and filtering means for filtering powder before it is dispensed from said outlet of said dispensing means, whereby said filtering means inhibits said outlet from becoming clogged.

29. A powder-dispensing brush according to claim 28, wherein said controlling means includes a valve disc which is movable in an axial direction relative to said housing and said sealing means includes urging means for urging said valve disc into intimate contact with said nozzle.

30. A powder-dispensing brush according to claim 29, wherein said housing includes an inwardly extending projection and said urging means includes a spring positioned between said valve disc and said projection.

31. A powder-dispensing brush according to claim 30, wherein said filtering means is a foam pad having an open cell construction, said foam pad being movably received in said housing between said valve disc and said projection and being surrounded by said spring.

32. A powder-dispensing brush according to claim 29, wherein said nozzle is rotatable between a first position in which said outlet is in alignment with said inlet and a second position in which said outlet is out of alignment with said inlet.

33. A powder-dispensing brush according to claim 32, wherein said controlling means includes limiting means for limiting the rotation of said nozzle such that said nozzle cannot be rotated beyond its said first and second positions.

34. A powder-dispensing brush according to claim 33, wherein said limiting means includes a pin extending outwardly from said housing and an arcuate slot provided in said nozzle so as to receive said pin in such a manner that said pin engages one end of said slot when said nozzle is in its said first position and said pin engages an opposite end of said slot when said nozzle is in its said second position.

35. A powder-dispensing brush according to claim 28, wherein said controlling means includes a bushing which is fixedly positioned in said one end of said housing, said bushing including another nozzle through wich said inlet passes and urging means for urging said another nozzle into intimate contact with said nozzle of said dispensing means.

36. A powder-dispensing brush according to claim 35, wherein said urging means includes an annular web having a flexibility selected such that said web is deflectable toward said opposite end of said housing in response to the insertion of said dispensing means into said bushing.

37. A powder-dispensing brush according to claim 36, wherein said web is molded monolithically with said bushing.

38. A powder-dispensing brush according to claim 36, wherein said another nozzle includes a projection through which a portion of said inlet passes, said projection extending from said another nozzle to said nozzle of said dispensing means.

39. A powder-dispensing brush according to claim 38, wherein said another nozzle includes levelling lugs extending from said another nozzle to said nozzle of said dispensing means.

40. A powder-dispensing brush according to claim 35, wherein said bushing includes holding means for holding said filtering means against said inlet such that said inlet is located between said filtering means and said outlet.

41. A powder-dispensing brush according to claim 40, wherein said filtering means is a foam pad having an open cell construction, said foam pad being held in a substantially stationary position by said holding means.

42. A powder-dispensing brush according to claim 35, wherein said nozzle of said dispensing means is rotatable between a first position in which said outlet is in alignment with said inlet and a second position in which said outlet is out of alignment with said inlet.

43. A powder-dispensing brush according to claim 42, wherein said controlling means includes limiting means for limiting the rotation of said nozzle of said dispensing means such that said nozzle cannot be rotated beyond its said first and second positions.

44. A powder-dispensing brush according to claim 43, wherein said limiting means includes a plurality of the ears projecting radially outwardly from said dispensing means and a plurality of opening provided in said bushing, each of said openings receiving a corresponding one of said ears such that each of said ears engages one end of a corresponding one of said openings when said nozzle of said dispensing means is in its said first position and such that each of said ears engages an opposite end of a corresponding one of said openings when said nozzle of said dispensing means is in its said second position.

* * * * *